US008209891B2

(12) United States Patent
Shellhouse et al.

(10) Patent No.: US 8,209,891 B2
(45) Date of Patent: Jul. 3, 2012

(54) MEMORIAL MARKER

(76) Inventors: Verne Shellhouse, Tiffin, OH (US); Curtland Smith, Tiffin, OH (US)

( * ) Notice: Subject to any disclaimer, the term of this patent is extended or adjusted under 35 U.S.C. 154(b) by 53 days.

(21) Appl. No.: 12/796,163

(22) Filed: Jun. 8, 2010

(65) Prior Publication Data

US 2010/0313492 A1 Dec. 16, 2010

Related U.S. Application Data

(60) Provisional application No. 61/186,543, filed on Jun. 12, 2009.

(51) Int. Cl.
*G09F 19/00* (2006.01)

(52) U.S. Cl. ..... 40/124.5; 40/592; 434/378; 116/173

(58) Field of Classification Search ..... 40/124.5, 40/592; 434/378; 248/519; 116/173
See application file for complete search history.

(56) References Cited

U.S. PATENT DOCUMENTS

| | | | | | |
|---|---|---|---|---|---|
| 2,148,660 | A * | 2/1939 | Sweeney | 40/124.5 |
| 3,828,456 | A * | 8/1974 | Rose | 40/592 |
| 3,977,110 | A * | 8/1976 | Yerger | 40/124.5 |
| 4,146,969 | A * | 4/1979 | Chaires | 33/295 |
| 4,590,883 | A * | 5/1986 | Steed et al. | 116/173 |
| D319,200 | S * | 8/1991 | Stephenson | D11/166 |
| 5,454,178 | A * | 10/1995 | Rivard | 40/124.5 |
| 5,517,790 | A | 5/1996 | Jennings | |
| 6,338,211 | B1 | 1/2002 | Carney | |
| 6,536,733 | B1 * | 3/2003 | Sharp | 248/519 |
| 7,047,680 | B2 * | 5/2006 | Myles | 40/607.1 |
| 7,424,864 | B2 * | 9/2008 | McCann | 116/174 |
| 7,934,690 | B1 * | 5/2011 | Walter | 248/539 |
| 2003/0221377 | A1 * | 12/2003 | Crawford et al. | 52/103 |
| 2004/0163496 | A1 * | 8/2004 | Timmerman | 81/53.2 |
| 2004/0169121 | A1 * | 9/2004 | Winn | 248/530 |
| 2008/0070081 | A1 * | 3/2008 | Franklin et al. | 429/26 |

OTHER PUBLICATIONS

"VG928", http://www.arkon.com/manuals/VG928.pdf, Dec. 2007.*

* cited by examiner

*Primary Examiner* — Gary Hoge
(74) *Attorney, Agent, or Firm* — Fraser Clemens Martin & Miller LLC; Jacob M. Ward

(57) ABSTRACT

A memorial marker having a base for placement on a grave marker is provided. A spring element is coupled to the base and configured to affix the base to the grave marker. A rod having a first end and a second end is coupled to the base at the first end. The rod is disposed in a substantially upright position. The second end of the rod permits an ornament such as at least one of a medallion and a flag to be coupled to the second end of the rod. A kit for the memorial marker and a related method for memorializing a deceased individual are also provided.

15 Claims, 5 Drawing Sheets

MEMORIAL MARKER

CROSS-REFERENCE TO RELATED APPLICATIONS

This application claims the benefit of U.S. Provisional Patent Application No. 61/186,543, filed on Jun. 12, 2009. The entire disclosure of the above application is hereby incorporated herein by reference.

FIELD OF THE INVENTION

The present disclosure relates to a memorial marker and, in particular, to a memorial marker for holding a medallion or a flag on a grave marker.

BACKGROUND OF THE INVENTION

It is known to have grave markers which provide for basic identification of a deceased individual along with general comments or quotations. Where the deceased individual is a veteran of the United States Armed Forces, it is also known to provide a memorial marker including at least one of a medallion and a United States flag. The medallion is generally formed from cast bronze, brass, or aluminum, and is held upright by a brass rod which is staked into the ground adjacent a grave of the deceased individual.

Conventional memorial markers are easily damaged or displaced by a lawn mower during routine cemetery maintenance. It is also known that memorial markers may be damaged or displaced when exposed to inclement weather, such as thunderstorms and the like. Typical memorial markers, and particularly those formed from valuable metals such as bronze or brass, are subject to vandalism and theft.

There is a continuing need for a memorial marker, method, and related kit for holding an ornament such as medallion or a flag at a grave, which minimizes an opportunity for damage or displacement, as well as an opportunity for vandalism and theft of the memorial marker.

SUMMARY OF THE INVENTION

In concordance with the instant disclosure, a memorial marker, method, and related kit for holding an ornament such as medallion or a flag at a grave, which minimizes an opportunity for damage or displacement, and minimizes an opportunity for vandalism and theft of the memorial marker, is surprisingly discovered.

In one embodiment, a memorial marker includes a base for placement on a grave marker. A spring element is coupled to the base and configured to affix the base to the grave marker. A rod having a first end and a second end is coupled to the base at the first end. The rod is disposed in a substantially upright position. The second end of the rod permits an ornament to be coupled to the second end of the rod.

In another embodiment, a kit for a memorial marker includes a base for placement on a grave marker. The base has a spring element coupled thereto and configured to affix the base to the grave marker. The kit also includes a rod having a first end and a second end. The rod is configured to be coupled to the base at the first end and disposed in a substantially upright position. The second end of the rod is configured to permit an ornament to be coupled to the second end of the rod.

In a further embodiment, a method for memorializing a deceased individual includes the steps of providing a kit for a memorial marker including a base for placement on a grave marker, the base including a spring element coupled thereto and configured to affix the base to the grave marker, and a rod having a first end and a second end, the rod configured to be coupled to the base at the first end and disposed in a substantially upright position, the second end of the rod configured to permit an ornament to be coupled to the second end of the rod; providing an ornament for memorializing the deceased individual; coupling the first end of the rod to the base; coupling the ornament to the second end of the rod; and affixing the base of the memorial marker to the grave marker.

In an exemplary embodiment, a memorial marker includes a base formed from aluminum. The base may measure approximately 2"×2"×⅝" for the purpose of stability. The base includes an acrylic foam spring element having adhesive on both sides thereof. The base may accommodate multiple rods for multiple ornaments. Where the ornament is a medallion, an external tube that cooperates with the rod may also be provided in order to use a support typically provided with the medallion. The rod measures approximately 2" to 20" in length, and approximately 3/16" to ½" in diameter. A cover tube is disposed over the rod and held securely to the base with a jam nut. The cover tube may have an inner diameter of approximately 3/16" to ½".

In another exemplary embodiment, a method for memorializing a veteran includes the following steps: 1) apply adhesive to an end of a threaded rod, and then screw the rod into a base until tight or flush, the base having a spring element with an adhesive layer covered with a removable cover strip; 2) slide an aluminum cover tube over the threaded rod; 3) apply adhesive to the threaded rod above the aluminum cover tube, and thread a jam nut onto the threaded rod to tighten the aluminum cover tube against the base; 4) apply adhesive to the threads on the threaded rod above the jam nut, screw a veterans medallion onto the threaded rod parallel to the base, and allow the adhesive to dry; 5) open an alcohol packet and clean a mounting surface on a grave marker with the alcohol packet, the mounting surface being on an appropriate side of the veteran to be honored; 6) remove the removable cover strip from the adhesive layer on the base; 7) place the assembled memorial marker on the mounting surface; and 8) position the memorial marker to appropriately honor the veteran.

DRAWINGS

The above, as well as other advantages of the present disclosure, will become readily apparent to those skilled in the art from the following detailed description, particularly when considered in the light of the drawings described herein.

DETAILED DESCRIPTION OF THE INVENTION

Figure 1:
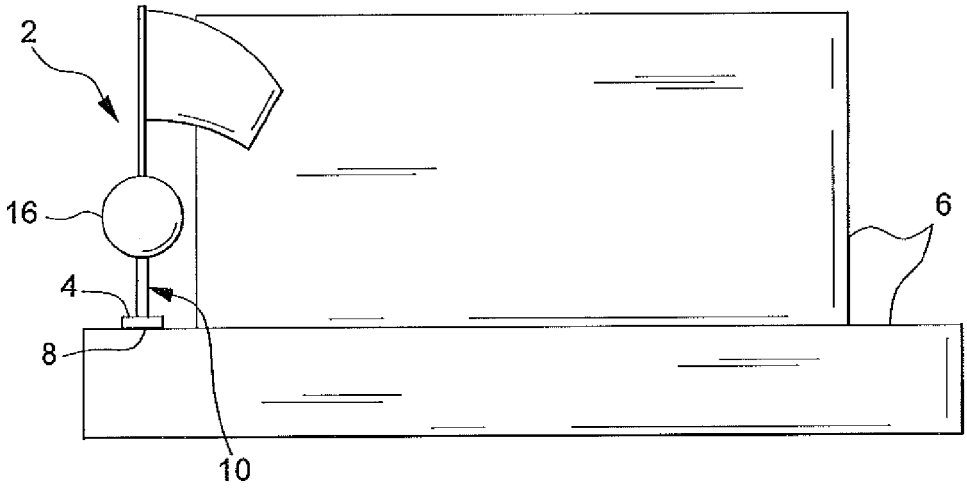
FIG. 1 is a front elevational view of an memorial marker according to one embodiment of the present disclosure, the memorial marker affixed to an upper surface of a grave marker.
Figure 2:
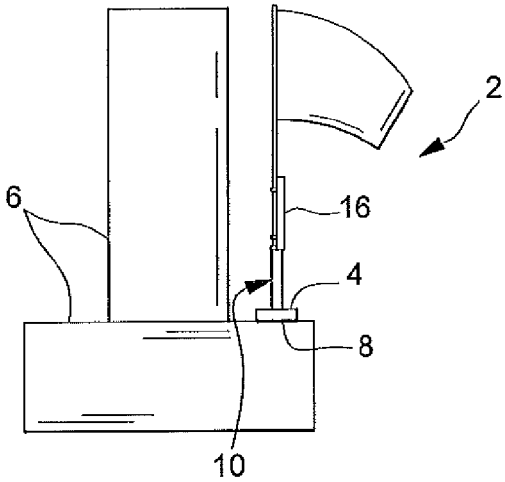
FIG. 2 is a side elevational view of the memorial marker shown in FIG. 1.

The following detailed description and appended drawings describe and illustrate various embodiments of the invention. The description and drawings serve to enable one skilled in the art to make and use the invention, and are not intended to limit the scope of the invention in any manner. In respect of the methods disclosed, the order of the steps presented is exemplary in nature, and thus, is not necessary or critical.

As shown in FIGS. 1-10, a memorial marker 2 includes a base 4 for placement on a grave marker 6 such as a headstone at a grave of a deceased individual. The base 4 has a spring element 8 coupled thereto and configured to affix the base 4 to the grave marker 6. The base may have any desired geometric design or dimensions. The base 4 may also be formed from any suitable material such as aluminum, brass, stainless steel or mild steel, plastic, and porcelain, as nonlimiting examples. In an illustrative embodiment, the base 4 is a substantially square aluminum block. Other materials for the base 4 having sufficient corrosion and weathering resistance may also be used.

The memorial marker 2 also has a rod 10 that is coupled to the base 4 and disposed in a substantially upright position. The rod 10 has a first end 12 and a second end 14. The rod 10 is coupled to the base 4 at the first end 12 of the rod 10. The rod 10 may be formed from stainless steel, as a nonlimiting example. The second end 14 of the rod 10 permits an ornament 16 to be coupled thereto. The ornament 16 may include at least one of a medallion and a flag. In a particular embodiment, the ornament 16 is a medallion having both a fixture for coupling with the rod 10, and a holder for the flag. One of ordinary skill in the art should understand that other types of ornaments 16 for memorializing a deceased individual may also be used, as desired.

In a particular embodiment, the base 4 includes a first threaded aperture 18 formed therein. An entirety of the rod 10 may be externally threaded, or at least one of the first end 12 and the second end 14 of the rod may be externally threaded, as desired. The threaded first end 12 of the rod 10 cooperates with the first threaded aperture 18 of the base 4 to couple the rod 10 to the base 4. The ornament 16 may also have a threaded hole (not shown) in the fixture that cooperates with the threaded second end 14 of the rod 10, for the purpose of coupling the ornament 16 to the rod 10.

Figure 3:
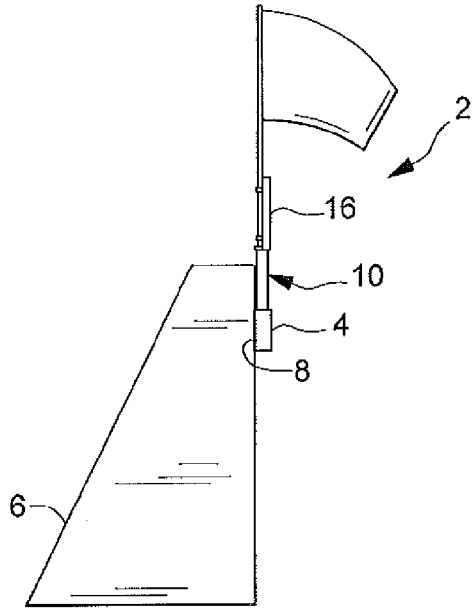
FIG. 3 is a side elevational view of an memorial marker according to another embodiment of the present disclosure, the memorial marker affixed to a rear surface of a grave marker.
Figure 5:
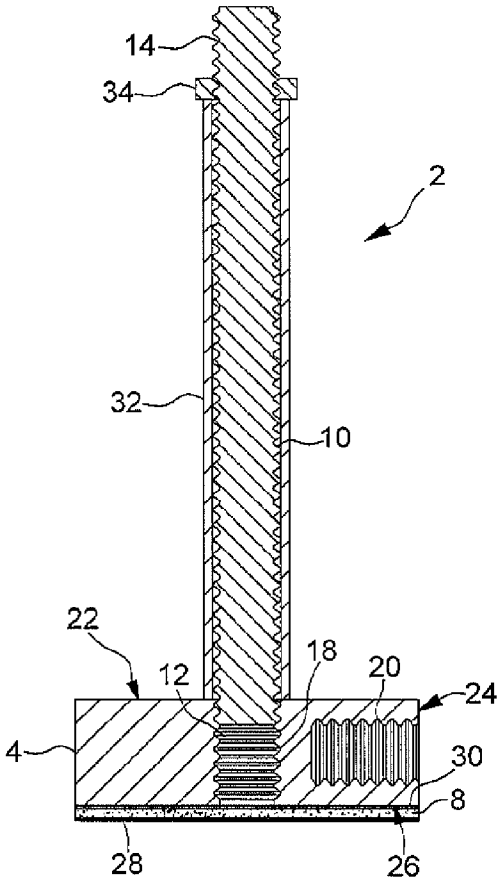
FIG. 5 is a cross-sectional front elevational view of the memorial marker shown in FIG. 4.
Figure 4:
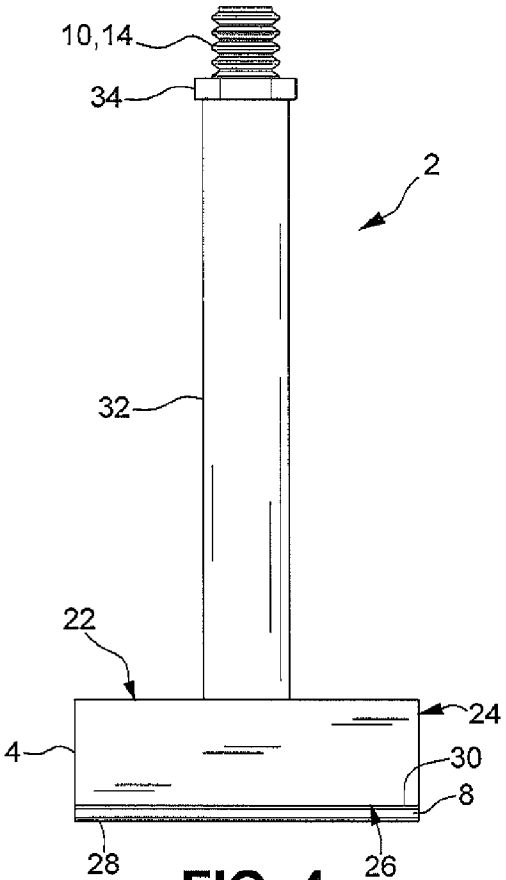
FIG. 4 is an enlarged, front elevational view of the memorial marker shown in FIG. 1, with the ornament removed to show a first end of a threaded rod.
Figure 7:
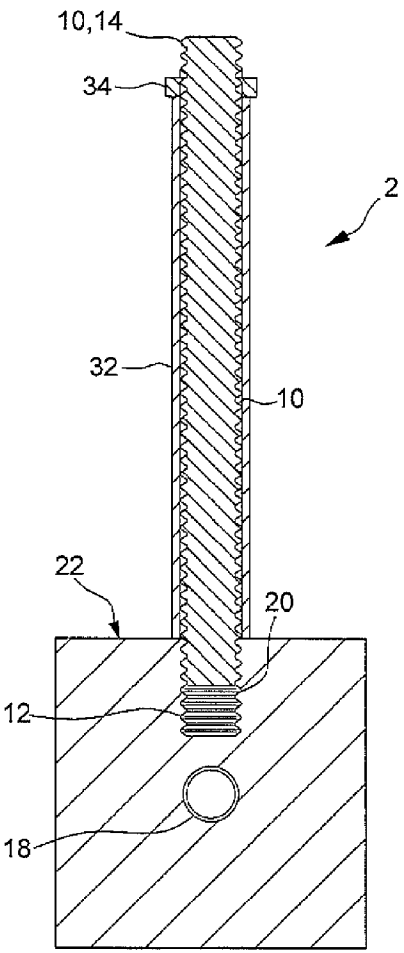
FIG. 7 is a cross-sectional front elevational view of the memorial marker shown in FIG. 6.
Figure 6:
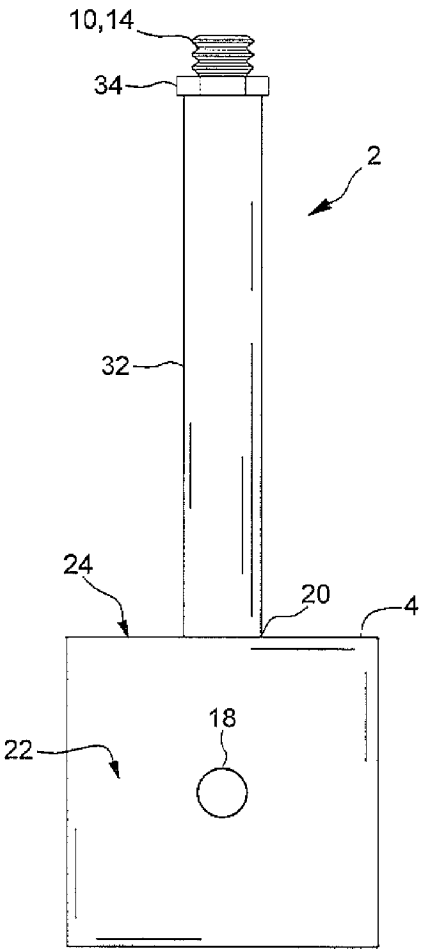
FIG. 6 is an enlarged, front elevational view of the memorial marker shown in FIG. 3, with the ornament removed to show a first end of a threaded rod.

As illustrated in FIGS. 5 and 7, the base 4 may include at least one second threaded aperture 20. The first threaded aperture 18 may be formed in a top surface 22 of the base 4. The second threaded aperture 20 may be formed in a side surface 24 of the base 4. The different locations of the first and second threaded apertures 18, 20 permits one to selectively base mount the memorial marker 2 as shown in FIGS. 1-2, 4-5, and 8-9, or back mount the memorial marker 2 as shown in FIGS. 3 and 6-7. It should be appreciated that other locations on the grave marker 6 for mounting the memorial marker 2 are also within the scope of the present disclosure.

The spring element 8 is disposed on a bottom surface 26 of the base 4. The spring element 8 may comprise a layer that covers substantially an entirety of the bottom surface 26. The spring element 8 may have a first adhesive layer 28 on one side of the spring element 8 and a second adhesive layer 30 on an other side of the spring element 8. The first adhesive layer 28 is configured to affix the spring element 8 to the grave marker 6. The second adhesive layer 30 affixes the spring element 8 to the base. An adhesive forming the first and second adhesive layers 28, 30 may be the same or different, as desired. The adhesive is selected to provide a holding strength to each of the base 4 and the grave marker 6 that is sufficient to militate against a separation of the base 4 from the grave marker 6 after the memorial marker 2 is installed.

In certain embodiments, the spring element 8 is a polymeric layer. The polymeric layer may be provided in the form of a foam layer. As a nonlimiting example, the spring element 8 may be formed from a closed cell polymer foam such as an acrylic foam. An exemplary spring element 8 having the first and second adhesive layers 28, 30 may be 3M™ VHB™ Tape, a very high bond double-sided acrylic foam tape that is commercially available from 3M in St. Paul, Minn., USA. A skilled artisan should understand that other suitable polymer materials and adhesives may also be employed.

It is surprisingly found that the spring element 8 compensates for a difference in thermal expansion and contraction between the base 4 and the grave marker 6. The difference in thermal expansion and contraction of the base 4 and the grave marker 6 may otherwise result in a separation of the base 4 from the grave marker 6, or even a damage to the grave marker 6, in the absence of the spring element 8. In particular, where an epoxy-based adhesive is instead disposed between the base 4 and the grave marker 6, it has been found that separation rapidly occurs with a seasonal fluctuation in temperature. The spring element 8 permits for a desirably long-term installation of the memorial marker 2 on the grave marker 6.

The memorial marker 2 of the present disclosure may further include a cover tube 32 disposed over the rod 10 and between the base 4 and the grave ornament 16. A height of the cover tube 32 is less than a height of the rod 10 to permit the second end 14 of the rod 10 to project outwardly from an end of the cover tube 32, for the purpose of coupling with the ornament 16. The cover tube 32 may militate against a corrosion of the underlying rod 10. The cover tube 32 may also be decorative and contribute to an aesthetic appearance of the memorial marker 2. The cover tube 32 may be formed from one of aluminum, brass, steel, and plastic, as nonlimiting examples. Other substantially weather-resistant materials may also be employed for the cover tube 32, as desired.

A locknut 34 may be employed to secure and immobilize the cover tube 32 against the base 4. For example, the locknut 34 may substantially seal the cover tube 32 to the base 4 to militate against water seeping into and cracking the cover tube 32 under freezing conditions. The locknut 34 may be a jam nut, as a nonlimiting example. The locknut 34 may cooperate with the second end 14 of the threaded rod 10 and be disposed between the cover tube 32 and the ornament 16. Upon a torquing of the locknut 34 on the second end 14 of the threaded rod 10, the locknut 34 abuts a top of the cover tube 32 and causes a bottom of the cover tube 32 to seat against the top surface 22 of the base 4.

Figure 9:
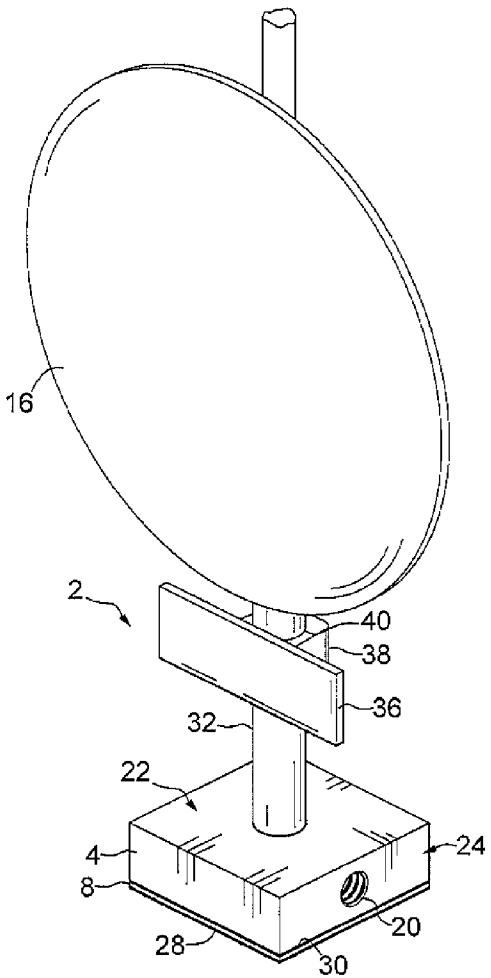
FIG. 9 is a front perspective view of the memorial marker shown in FIG. 8.
Figure 8:
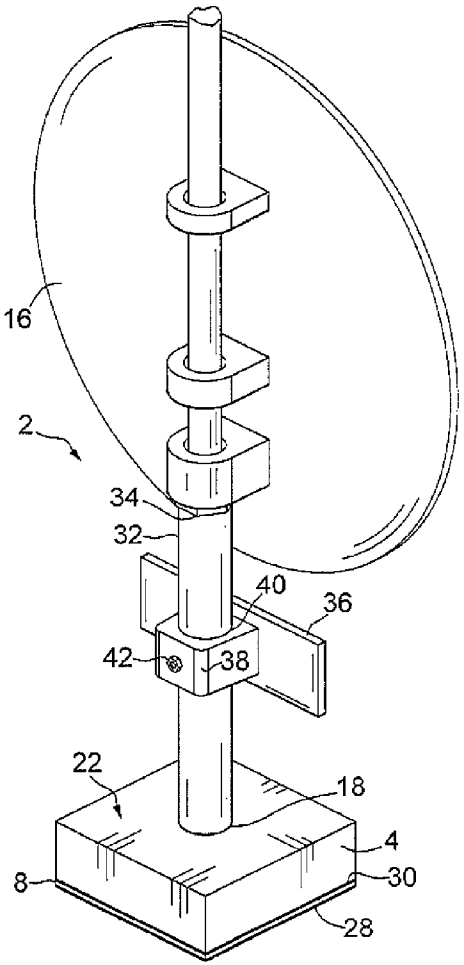
FIG. 8 is a rear perspective view of the memorial marker shown in FIG. 1, with an ornamental plate affixed to a cover tube of the memorial marker.

Referring to FIGS. 8 and 9, the memorial marker 2 may also have a second ornament 36. For example, the second ornament 36 may be a plate with an identifying insignia, name, or saying engraved thereon. The second ornament 36 may be affixed to the cover tube 32. In the embodiment shown, the second ornament 36 includes a fixture 38 having a hole 40 through which the cover tube 32 may be slid. The fixture 38 may also have a fastener 42 such as a set-screw, although other suitable fasteners 42 may also be employed. The fastener 42 is configured to securely hold the second ornament 36 to the cover tube 32 of the memorial marker 2.

Figure 10:
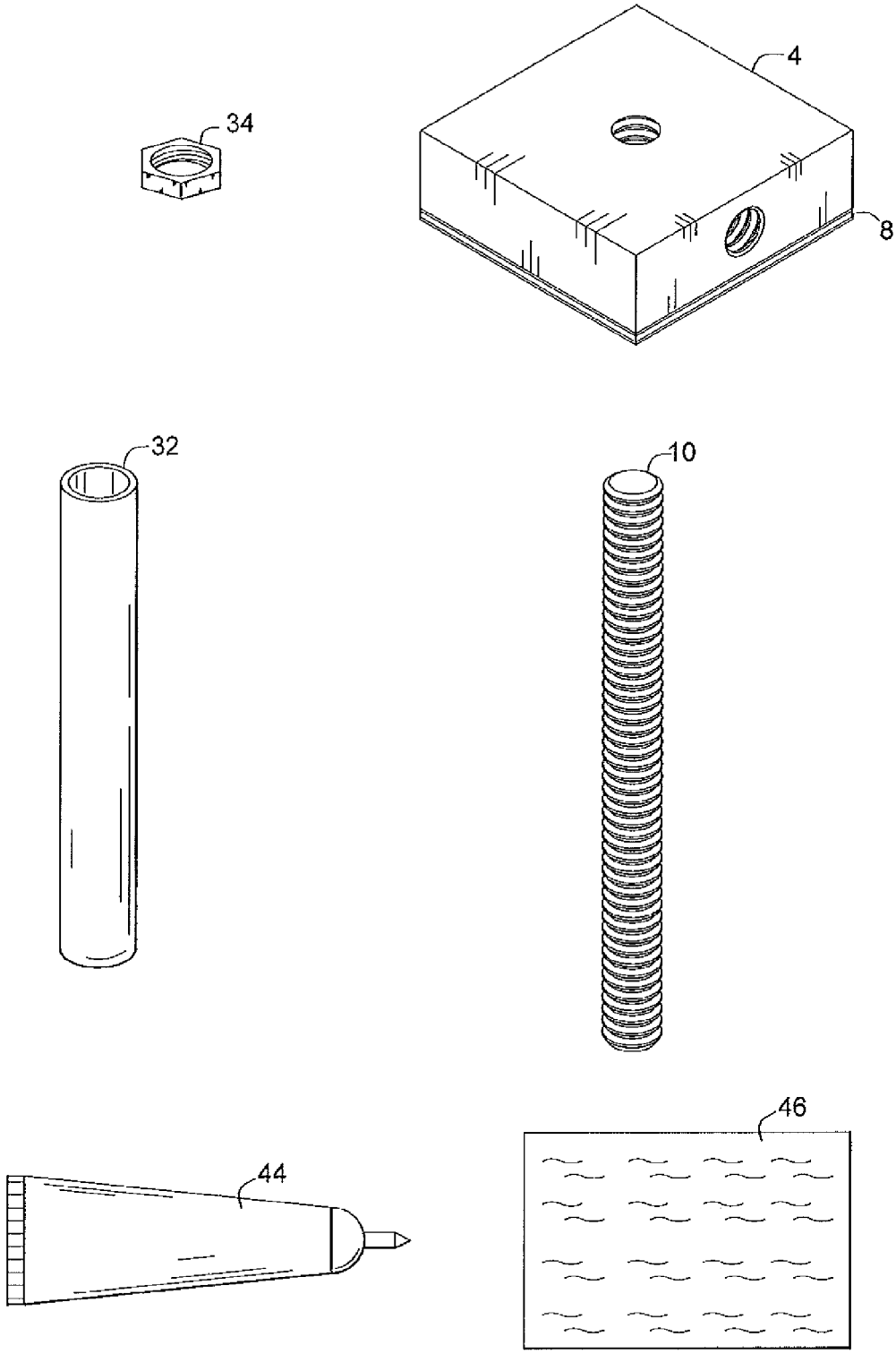
FIG. 10 is a side elevational view of a kit for the memorial marker shown in FIGS. 1-9.

It should be understood that the present disclosure also includes a kit for the memorial marker 2, for example, as shown in FIG. 10. The kit includes the base 4 for placement on the grave marker 6. The base 4 may be provided with the spring element 8 coupled thereto, or as a separate component, as desired. Where the spring element 8 is provided with the second adhesive layer 30 pre-affixed to the base 4, the first adhesive layer 28 may be provided with a removable cover strip (not shown) that militates against a contamination of the first adhesive layer 28 prior to use. The kit also includes the rod 10 configured to be coupled to the base 4 at the first end 12 and arranged in a substantially upright position. The second end 14 of the rod 10 is configured to permit the ornament 16 to be coupled thereto.

The ornament 16 such as at least one of the medallion and the flag configured to be coupled to the second end 14 of the rod 10 may be provided with the kit. Alternatively, where the ornament 16 is obtained separately, for example, from a government agency such as the Department of Veterans Affairs, a pre-existing rod may be removed from the separately obtained ornament 16 prior to coupling the ornament with the rod 10 of the memorial marker 2 of the present disclosure The kit may further include the cover tube 32 configured to be disposed over the rod 10, the at least one locknut 34 configured to be disposed between the cover tube 32 and the ornament 16, an alcohol pad 46 for cleaning a surface of the grave marker 6 upon which the base 4 is to be placed, and an additional adhesive 44 for applying to the first end 12 of the rod 10 and the base 4 to permanently affix the rod 10 to the base 4. The additional adhesive 44 may be provided in an easy-to-dispense tube for application to at least one of the first and second ends 12, 14 of the rod 10, the locknut 34, the ornament 16, and to the cover tube 32. The additional adhesive 44 may include at least one of an acrylic, cyanoacrylate, epoxy, urethane and hot melt adhesive, as nonlimiting examples. In one embodiment, the additional adhesive 44 is commercially available under the Loctite® brand from Henkel AG & Co. located in Düsseldorf, Germany. It should be understood that the additional adhesive 44 is not used between the spring member 8 of the base 4 and the grave marker 6.

The present disclosure also includes a method for memorializing the deceased individual. The method further includes the steps of providing the kit as described hereinabove. The ornament 16 such as at least one of the medallion and the flag is also provided for memorializing the deceased individual. The first end 12 of the rod 10 is coupled to the base 4, for example, by inserting the rod 10 into one of the first and second apertures 18, 20 formed in the base 4. The cover tube 32 may be disposed over the rod 10 after the first end 12 of the rod 10 has been coupled to the base 4. The locknut 34 is also disposed on the second end 14 of the rod 10 to secure and substantially immobilize the cover tube 32 against the base 4. At least a portion of the second end 14 of the rod 10 remains exposed after the locknut 34 is placed thereon, for coupling with the ornament 16.

The ornament 16 is coupled to the second end 14 of the rod 10, for example, by inserting the rod 10 into the threaded hole of the ornament 16. The base 4 of the memorial marker 2 is then affixed to the grave marker 6, for example, by disposing the first adhesive layer 28 of the spring member 8 against the surface of the grave marker 6 and applying pressure to cause to first adhesive layer 28 to firmly adhere to the grave marker 6. Prior to disposing the base 4 of the memorial marker 2 on the grave marker 6, the surface at the desired location on the grave marker 6 may be cleaned, for example, with the alcohol pad 46. Alternative means for cleaning the grave marker 6 to remove dirt and other debris from the surface may also be used.

The method of the present disclosure may further including the steps of applying the additional adhesive 44 to the first end 12 of the rod 10 prior to affixing the first end 12 of the rod to the base 4, and applying the additional adhesive 44 to the second end 14 of the rod 10 prior to placing the locknut 34 between the cover tube 32 and the ornament 16.

Advantageously, the memorial marker 2 honors deceased individuals such as veterans with a proper medallion and flag display, i.e., a display that stands upright. The memorial marker 2 can also accommodate and display ornaments other than military medallions. For example, other ornaments, such as flags and engraved photographs may also be used. The wind during inclement weather cannot spin the ornament on the memorial marker 2 around. The memorial marker 2 also optimizes the time associated with cemetery maintenance, as grounds keepers do not need to spend time straightening medallions and flags, mowing around the memorial marker 2, and fixing the bent rods of the memorial marker 2.

While certain representative embodiments and details have been shown for purposes of illustrating the invention, it will be apparent to those skilled in the art that various changes may be made without departing from the scope of the disclosure, which is further described in the following appended claims.

What is claimed is:

1. A memorial marker, comprising:

a grave marker;

a base placed on the grave marker, the base including a spring element coupled thereto and affixing the base to the grave marker; and a rod having a first end and a second end, the rod coupled to the base at the first end and disposed in a substantially upright position, the second end of the rod having an ornament coupled thereto.

2. The memorial marker according to claim 1, further including a cover tube disposed over the rod and between the base and the ornament.

3. The memorial marker according to claim 2, further including a locknut cooperating with the second end of the threaded rod and disposed between the cover tube and the ornament, the locknut securing and substantially immobilizing the cover tube against the base.

4. A memorial marker, comprising:

a base for placement on a grave marker, the base including a spring element coupled thereto and configured to affix the base to the grave marker; and a rod having a first end and a second end, the rod coupled to the base at the first end and disposed in a substantially upright position, the second end of the rod having an ornament coupled thereto, wherein the ornament is a medallion, and wherein the base includes a first threaded aperture formed therein, the rod is threaded and the first end of the rod cooperates with the first threaded aperture of the base, and the ornament has a threaded hole cooperating with the second end of the threaded rod, the threaded hole formed in a projection extending from the medallion.

5. The memorial marker according to claim 4, wherein the base includes a second threaded aperture.

6. The memorial marker according to claim 5, wherein the first threaded aperture is formed in a top surface of the base, the spring element is disposed on a bottom surface of the base, and the second threaded aperture is formed in a side surface of base, wherein the side surface is oriented perpendicular to the top surface.

7. A memorial marker, comprising:

a grave marker:, a base for placement on the grave marker, the base including a spring element coupled thereto and configured to affix the base to the grave marker; and a rod having a first end and a second end, the rod coupled to the base at the first end and disposed in a substantially upright position, the second end of the rod configured to permit an ornament to be coupled to the second end of the rod, wherein the spring element includes a polymeric layer formed from a closed cell foam, wherein a first adhesive layer is disposed on one side of the polymeric layer and a second adhesive layer is disposed on an other side of the polymeric layer, and wherein the first adhesive layer is configured to affix the polymeric layer to the grave marker, and the second adhesive layer affixes the polymeric layer to the base.

8. The memorial marker according to claim 7, wherein the polymeric layer is a closed cell acrylic foam.

9. A kit for a memorial marker, comprising:

a base for placement on a grave marker, the base including a spring element coupled thereto and configured to affix the base to the grave marker, wherein the base includes a first threaded aperture and a second threaded aperture formed therein, wherein the first threaded aperture is formed in a top surface of the base, the spring element is disposed on a bottom surface of the base, and the second threaded aperture is formed in a side surface of base, and wherein the side surface is oriented perpendicular to the top surface; and a rod having a first end and a second end, the rod configured to be coupled to the base at the first end and disposed in a substantially upright position, the second end of the rod configured to permit an ornament to be coupled to the second end of the rod.

10. The kit according to claim 9, further including an ornament configured to be coupled to the second end of the rod, wherein the ornament is at least one of a medallion and a flag.

11. The kit according to claim 9, further including a cover tube configured to be disposed over the rod.

12. The kit according to claim 11, further including a locknut configured to be disposed between the cover tube and the ornament, the locknut securing and substantially immobilizing the cover tube against the base.

13. The kit according to claim 12, further including an alcohol pad for cleaning a surface of the grave marker upon which the base is placed.

14. The kit according to claim 13, further including an additional adhesive for applying to the first end of the rod and the base to permanently affix the rod to the base.

15. A method for memorializing a deceased individual, comprising the steps of:

providing a kit for a memorial marker including a base for placement on a grave marker, the base including a spring element coupled thereto and configured to affix the base to the grave marker, a rod having a first end and a second end, the rod configured to be coupled to the base at the first end and disposed in a substantially upright position, the second end of the rod configured to permit an ornament to be coupled to the second end of the rod, a cover tube configured to be disposed over the rod, a locknut configured to be disposed between the cover tube and the ornament, the locknut securing and substantially immobilizing the cover tube against the base, an alcohol pad for cleaning a surface of the grave marker upon which the base is placed, and an additional adhesive for applying to the first end of the rod and the base to permanently affix the rod to the base;

providing an ornament for memorializing the deceased individual;

applying the additional adhesive to the first end of the rod;

coupling the first end of the rod to the base;

cleaning with the alcohol pad a surface of the grave marker to which the base of the memorial marker is to be affixed;

disposing the cover tube over the rod after the first end of the rod has been coupled to the base;

applying the additional adhesive to the second end of the rod;

disposing the locknut on the second end of the rod to secure and substantially immobilize the cover tube against the base, wherein at least a portion of the second end of the rod is exposed for coupling with the ornament;

coupling the ornament to the second end of the rod; and affixing the base of the memorial marker to the grave marker.

* * * * *